United States Patent [19]

Nordlof

[11] Patent Number: 5,033,342

[45] Date of Patent: Jul. 23, 1991

[54] ROLL TYPE STOCK FEED APPARATUS FOR A PUNCH PRESS

[76] Inventor: Richard D. Nordlof, 3312 Crest Rd., Rockford, Ill. 61107

[21] Appl. No.: 404,118

[22] Filed: Sep. 7, 1989

[51] Int. Cl.[5] ..... B65H 17/22

[52] U.S. Cl. ..... 83/73; 83/272; 226/138

[58] Field of Search ..... 83/72, 73, 222, 225, 83/241, 261, 208, 209; 226/136, 137, 138, 139, 152, 154, 156; 72/24, 28, 421

[56] References Cited

U.S. PATENT DOCUMENTS 3,038,645 6/1962 Nordlof .
3,707,255 12/1972 Ridgway et al. .
4,078,416 3/1978 Voorhees et al. .
4,788,908 12/1988 Sugiyama .

*Primary Examiner*—Timothy V. Eley
*Attorney, Agent, or Firm*—Vernon J. Pillote

[57] ABSTRACT

A roll type stock feed apparatus having a servomotor drive and a programmable controller operable to drive the feed rolls to feed stock in preselected incremental lengths. A ram position sensor is arranged to be actuated when the ram moves in a downstroke and to be deactuated when the ram moves in an upstroke and the programmable controller is operated in response to the sensor to drive the feed rolls when the sensor is deactuated. The interval between successive actuations of the ram position sensor is timed to measure press speed. The interval between actuation and deactuation of the ram position sensor is also timed to control shifting of one feed roll into feeding engagement with the stock when the ram is at a preselected position intermediate the ram positions at which the sensor is actuated and deactuated. The upper feed roll is shifted into and out of feed position by a double acting piston, and air under regulated pressure is supplied to the upper side of the piston to bias the feed roll downwardly and air under pressure is selectively supplied and exhausted from the underside of the piston to effect shifting of the upper feed roll out of and into feeding engagement with the stock.

19 Claims, 4 Drawing Sheets

DRIVE AMPLIFIER
OUTPUT INTERFACE
CLOCK
CPU
ROM
RAM
ENCODER INTERFACE
INPUT INTERFACE
OPERATOR INTERFACE
PC

ROLL TYPE STOCK FEED APPARATUS FOR A PUNCH PRESS

BACKGROUND OF THE INVENTION

Roll type stock feed apparatus have heretofore been made having a servomotor and a programmable servomotor controller for driving the feed rolls to advance stock in selected increments. Some prior servo drive feed apparatus, for example as disclosed in U.S. Pat. Nos. 4,078,416 and 4,788,908, provide a rotary resolver or encoder driven from the press crankshaft, to provide signals correlative with the press crankshaft position for timing the feed apparatus with the press. However, such rotary resolvers and encoders are expensive and are time consuming to install and adjust. U.S. Pat. No. 3,707,255 discloses feed rolls having a hydraulic servo drive in which a switch is mounted on the press frame for actuation during the upward movement of the press ram. When the switch is actuated, the clamp roll is first operated to clamp the stock and, after time delay sufficient to effect clamping, the hydraulic servo drive motor is operated to advance the stock the selected feed length. The time required for moving the clamp roll into clamping engagement with the stock does not change with press speed and corresponds to a substantially higher angular movement of the press crank at high press speeds than at low press speeds. Thus, the press crank position at which the stock feeding is started would vary markedly with changes in press speed.

SUMMARY OF THE INVENTION

It is an object of the present invention to provide a roll tYpe stock feed apparatus having a servomotor drive, and which can be easilY and economically connected to a press for operation in timed relation therewith.

Another object of this invention is to provide a roll type stock feed apparatus having a servomotor drive for the feed rolls and an improved arrangement for shifting the feed rolls into and out of feeding engagement with the stock, in a manner to minimize the time required for shifting the feed rolls.

Still another object of this invention is to provide a roll type stock feed apparatus having a servomotor drive and an improved timing system for the stock feed apparatus including a ram position sensor adapted to produce a first ram position signal when the ram moves to a preselected level above bottom dead center during the downstroke of the ram and a second ram position signal when the ram moves in an upstroke to the preselected level above bottom dead center, and means responsive to the first and second ram position signals for producing a third timing signal corresponding to a preselected ram position intermediate the ram positions at which the ram actuates and deactuates sensor means.

DETAILED DESCRIPTION

Figure 1:
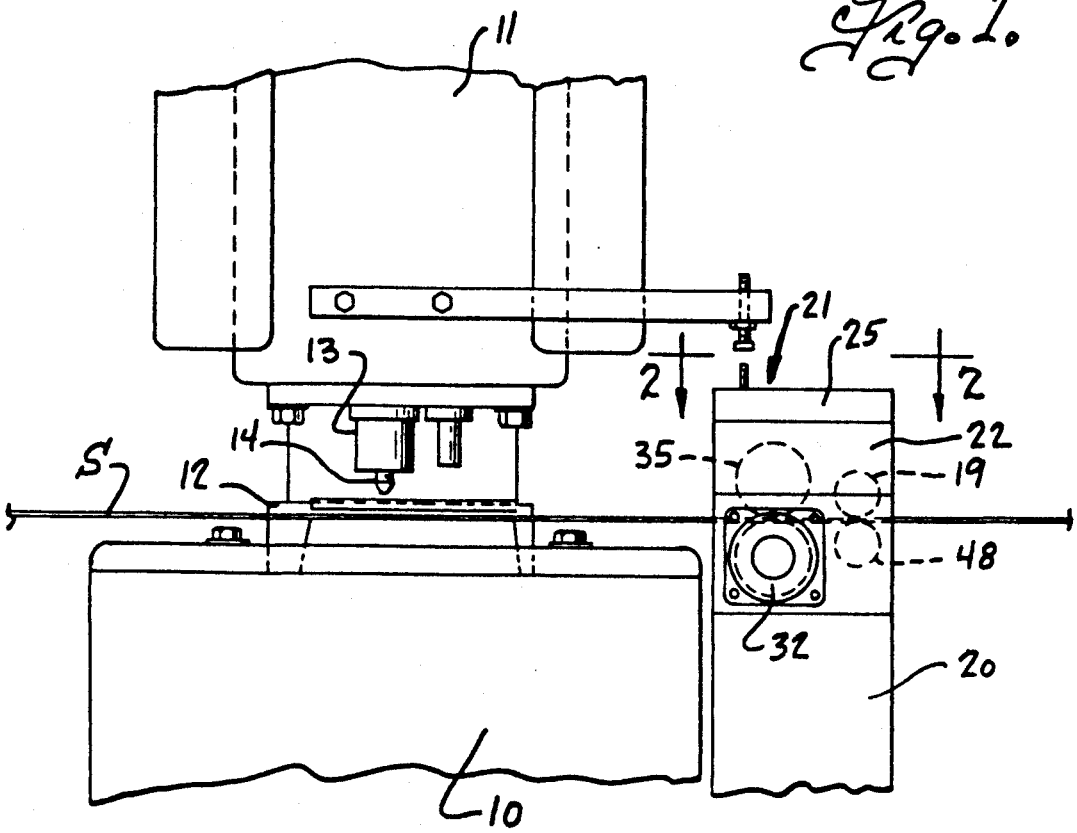
FIG. 1 is a fragmentary front view of a press having a roll type stock feed apparatus applied thereto.
Figure 5:
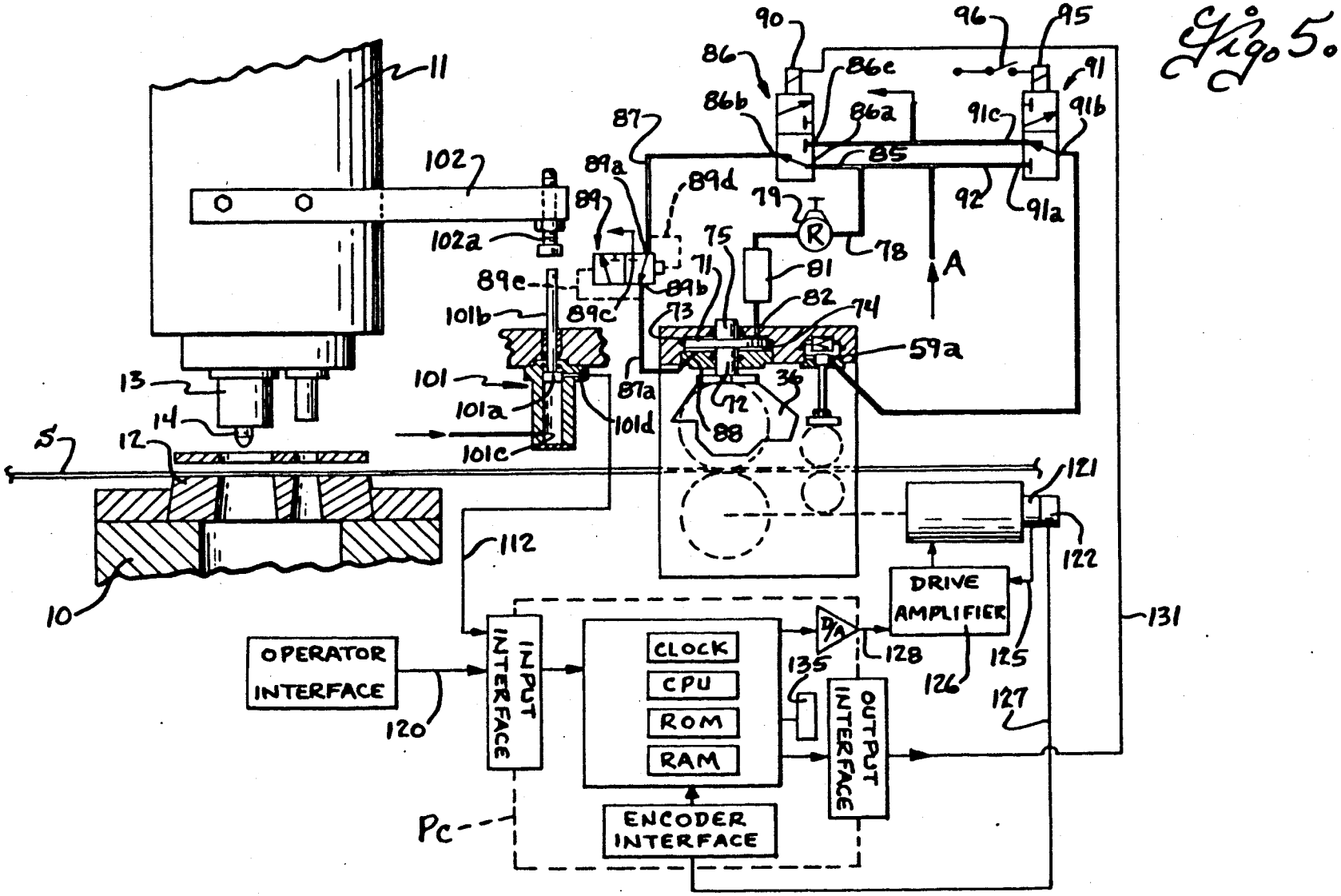
FIG. 5 is a diagrammatic view of a punch press and the stock feed apparatus and controls therefor.

Reference is now made more specifically to FIGS. 1 and 5 wherein there is shown a press having a base 10 and a ram 11 mounted for reciprocation toward and away from the base. The ram is driven by a press crank (not shown) that is operative during each revolution to drive the ram from a top dead center position indicated at Tdc in timing diagram in FIG. 6, line A, through a downstroke to a bottom dead center position Bdc and then through an upstroke back to top dead center. Die means such as shown at 12 are mounted on the base of the press and punch means shown at 13 are mounted on the ram for reciprocation to and out of engagement with the die. Some punch and die sets, for example progressive punch and dies, punch a pilot hole or holes in the stock at one station and have a pilot pin or pins 14 adapted to enter the pilot hole at a subsequent die station, to accurately locate the workpiece at the second die station.

Figure 2:
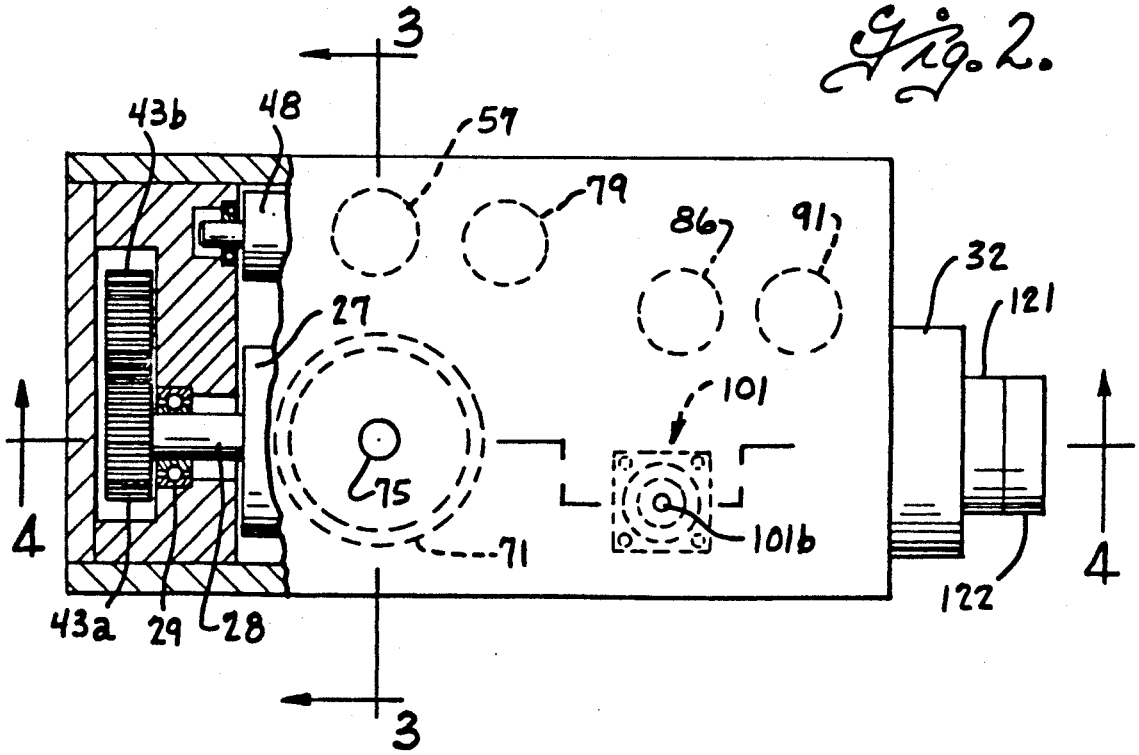
FIG. 2 is a plan view of the stock feed apparatus taken on the plane 2—2 of FIG. 1, with parts broken away and shown in section to illustrate details of construction.
Figure 3:
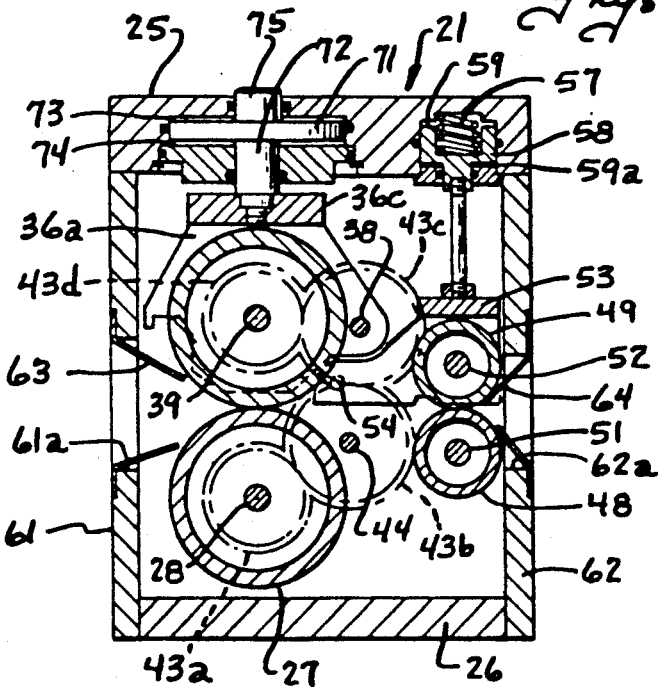
FIG. 3 is a vertical sectional view through the stock feed apparatus taken on the plane 3—3 of FIG. 2.
Figure 4:
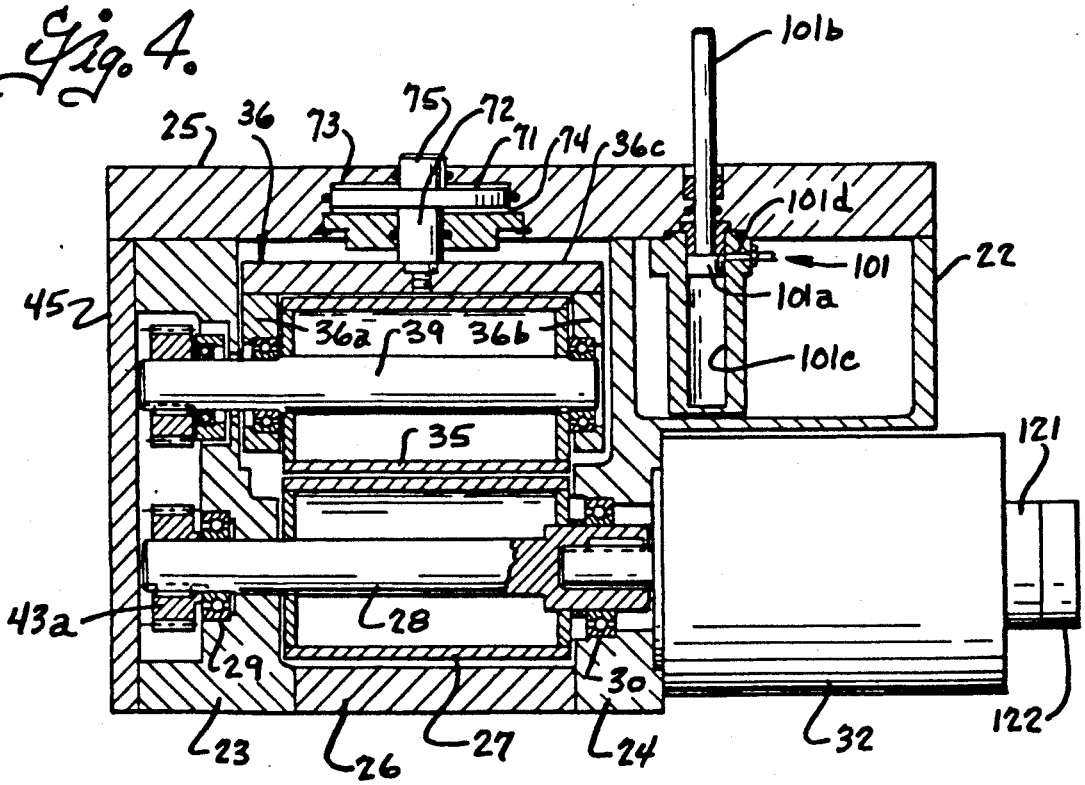
FIG. 4 is a longitudinal sectional view through the stock feed apparatus taken on the plane 4—4 of FIG. 2.

A roll type stock feed apparatus 21 is provided for feeding stock in preselected incremental lengths to the press. The stock feed apparatus 21 includes a rigid feed frame structure 22 mounted on a feed roll support shown at 20 in FIG. 1, at a location adjacent one side of the press to support the feed rolls at a level adjacent the level of the top of the die assembly 12 for feeding strip stock S to or from the die assembly. As best shown in FIGS. 2–4, the feed frame structure includes generally upright frame members 23 and 24 that extend lengthwise of the stock feed path and are rigidly interconnected by a top plate 25 and a bottom plate 26. A lower feed roll 27 is rigidly affixed to a shaft 28 that is rotatably supported by bearings 29 and 30 on the frame members 23 and 24. A servomotor 32 is rigidly mounted on the frame member 24 and has its output shaft 33 drivingly connected to the roller shaft 28. An upper feed roll 35 is mounted on a roll support yoke 36 for limited movement toward and away from the lower feed roll. The support yoke 36 includes end members 36*a* and 36*b* that are rigidly connected by a cross member 36*c* and the end members are swingably supported on stub shafts 38 (FIG. 3) fixed to the frame members 23 and 24. The upper feed roll 35 is fixed to a shaft 39 that is rotatably supported by bearings 41 in the yoke end members 36*a* and 36*b*. In the preferred embodiment illustrated, the upper feed roll is drivingly connected to the lower feed roll for rotation at the same speed but in a relatively opposite direction. As shown in FIGS. 3 and 4, a gear 43*a* on the drive roll shaft 28 meshes with an idler gear 43*b* supported on a stub shaft 44. Idler gear 43*b* meshes with an idler gear 43*c* on stub shaft 38 and drives a gear 43*d* on the upper feed roll shaft 39. Gears 43*a*–43*d* have the same pitch diameter and drive the upper feed roll at the same speed but in an opposite direction to the lower feed roll, while accommodating limited shifting movement of the upper feed roll in a direction crosswise of the stock feed relative to the lower feed roll. An end cover plate 45 is affixed to the frame member 23 to enclose the gears 43*a*–43*d*.

Anti-backup rolls 48 and 49 are preferably provided and, as best shown in FIG. 3, one of the backup rolls 48 is mounted on a crossshaft 51 that is rotatably supported on the frame members 23 and 24, and a one-way clutch (not shown) is provided to allow rotation of the roll 48 in the direction of forward stock feed while preventing reverse rotation. The upper roll 49 is fixed to a shaft 52 that is rotatably supported in a yoke 53 (see FIG. 3). Yoke 53 is mounted for limited pivotal movement on the frame members 23 and 24 by pintles 54 to allow shifting of the roll 49 toward and away from the lower roll 48. As shown in FIG. 3, the roll 49 is yieldably biased toward the lower roll 48 as by a spring 57, and a means such as an actuator piston 58 disposed in cylinder 59 in the top plate, is provided for selectively shifting the roll 49 away from the roll 48, to facilitate threading of stock through the feed roll.

As shown in FIG. 3, forward and rear cover plates 61 and 62 are fixed to the frame members 23 and 24 to enclose the feed roll assembly and have openings 61*a* and 62*a* to allow passage of stock therethrough. Inlet and outlet stock feed guides 63 and 64 are provided to facilitate guiding of the stock into and out of the nip between the rollers.

When the punch and die assembly utilize pilot pins for final positioning of the stock during each cycle, it is necessary to release the feed rolls from the stock prior to entrance of the pilot pins into the pilot holes and to reapply the feed rolls prior to initiating drive of the feed rolls. The time required to move the feed rolls into gripping engagement with the stock and the time required to move the feed rolls out of gripping engagement with the stock does not change with the speed of the press and, as the speed of the press is increased, the angular movement of the press during these intervals increases correspondingly. An improved pneumatic system is provided for applying and releasing the feed roll, to reduce the time intervals required for applying and releasing the feed rolls during each cycle. As best shown in FIGS. 3–5, a double acting feed roll actuator piston 71 has a piston rod 72 connected to the shiftable roll support yoke 36 and the upper plate 25 of the feed roll frame is constructed and arranged to form an upper actuator chamber 73 at the upper side of the piston and a lower actuator chamber 74 at the lower side of the piston. Piston 71 is advantageously provided with an upper rod 75 having a cross section at least as large as the lower rod 72, so that the area exposed to chamber 74 at the underside of the actuator piston is at least equal to the area of the upper side of the piston exposed to the pressure of the chamber 73. As schematically shown in FIG. 5, air under pressure from the source of pressurized air such as the plant air supply designated A, is supplied through line 78 and a pressure regulator 79 and accumulator 81 to an inlet 82 leading to the upper actuator chamber 73, to yieldably bias the upper feed roll downwardly with a substantially constant pressure determined by regulator 79. The regulator 79 is preferably of the adjustable type to enable adjustment of the feed roll pressure to accommodate different types of stock and stock feed conditions.

Means are provided for selectively applying and exhausting pressurized air from the air supply A to the actuator chamber 74 at the underside of the feed roll actuator piston 71, to release and apply the feed rolls. As shown in FIG. 5, air is supplied from the air supply A through a line 85 to the pressure inlet 86*a* of a normally open three-way valve 86. The controlled outlet 86*b* of the three-way valve 86 is connected through a line 87, 87*a* to an inlet 88 communicating with the lower actuator chamber 74. Air under high pressure from the air supply will flow rapidly into the lower actuator chamber when the valve 86 is in its normally open condition, to release the upper feed roll. A quick exhaust valve 89 is advantageously provided in the line 87, to speed up exhausting air from the lower actuating chamber 74 when the valve 86 is moved to its closed position blocking pressure inlet 86*a* and communicating the controlled outlet port 86*b* with the exhaust port 86*c*, to thereby reduce the time required to apply the feed roll. The quick exhaust valve 89 is of known construction and, as graphically illustrated in FIG. 5, has a pressure inlet port 89*a* connected to line 87 and a controlled outlet port 89*b* connected through the line 87*a* to the inlet 88 in the lower actuator chamber 74. When the inlet port 89*a* is pressurized, pressure is supplied through a pilot passage 89*d* to shift the quick exhaust valve to a position communicating the pressure port 89*a* with the controlled outlet port 89*b* as shown in FIG. 5. When the port 89*a* is connected to exhaust, pressure from line 87*a* is supplied through a pilot passage 89*e* to shift the valve to a position blocking the pressure inlet port 89*a* and communicating the controlled outlet port 89*b* with the exhaust outlet 89*c*. As is conventional, the quick exhaust valve has relatively large exhaust passages and ports for rapid flow during exhaust. With the above-described arrangement, when control valve 86 is allowed to move to its normally open condition, air under supply line pressure is supplied through line 87, quick exhaust valve 89 and line 87 to the lower actuator chamber to rapidly pressurize the lower chamber and move the piston 71 and upper feed roll to a raised position. When control valve 86 is moved to its closed position and connects the controlled outlet port with the exhaust outlet 86*c*, the quick exhaust valve 89 is shifted to a position connecting the controlled outlet port 89*b* with the exhaust outlet 89*c*, to rapidly exhaust pressure from the lower actuator chamber 74 so that pressure at the upper side of the piston rapidly moves the upper feed roll 35 down into feeding engagement with the stock. An adjustable stop can be provided to adjustably limit upward movement of the actuator piston 71, to accommodate stock of different thickness and to limit the amount of travel of the piston to a position releasing the stock.

It is also schematically shown in FIG. 5, a normally closed actuator valve 91 is provided for actuating the piston actuator 58 for the anti-backup roll 49 to a release position. As shown, the pressure inlet port 91*a* of valve 91 is connected through a line 92 to the pressure supply and the controlled outlet port 91*b* is connected through a passage 93 to an actuator chamber 59*a* at the underside of piston 58. Valve 91 is normally closed and controlled outlet 91*b* is normally positioned to communicate with the exhaust outlet port 91*c* so that the upper anti-backup roll is normally pressed into engagement with the stock by spring 57. Valve 91 conveniently has an electro-responsive actuator 95 which can be selectively energized under control of a switch 96 to move the valve to an open position in which it supplies pressure to actuator chamber 59*a* to raise the anti-backup roll.

In accordance with another aspect of the present invention, provision is made for timing operation of the servomotor controlled stock feed apparatus in response to the position of the press ram during each cycle. A ram position sensor 101 is mounted on the feed roll frame 21 and arranged to be actuated by a sensor actuator 102 that is mounted for vertical reciprocation with the ram. The ram position sensor is arranged to be actuated by the actuator 102 on the ram when the ram moves in a downstroke to a preselected level above bottom dead center, and to be deactuated when the press ram moves in the following upstroke to substantially the same preselected level above bottom dead center. In the preferred embodiment illustrated, the ram position sensor includes a plunger 101*a* mounted for vertical movement and a stem 101*b* that extends above the feed frame at a location to be engaged by the plunger actuator 102. The plunger 101*a* is yieldably biased to a raised position, as by a pneumatic cushion from the air supply through line 103 to a plunger chamber 101*c* and the plunger is constructed and arranged to accommodate the vertical movement of the ram after the plunger is actuated and before bottom dead center of the ram. As shown, the plunger chamber 101*c* is made sufficiently long to accommodate the vertical movement of the ram. Alternatively, an over travel actuator can be provided on the stem 101*b*.

The ram position sensor 101 is arranged to produce a discrete electrical signal having a first state when the ram position sensor is in a first or normal position, and a second state when the ram position sensor is actuated and moved out of the normal position and until the sensor moves back to its normal position upon deactuation. The means 101*d* for sensing when the plunger 101*a* is in its normal position and movement of the plunger 101*a* out of its normal position can be of various types and may, for example, comprise an eddy current sensor, a photoelectric sensor, a proximity type sensor or even a mechanical switch. As shown in the timing diagram of FIG. 6, line B, the plunger is actuated at a ram position P1 during each press cycle when the ram moves in a downstroke to a preselected level above bottom dead center, and the plunger is deactuated at a ram position P2 in each press cycle when the ram moves in an upstroke to substantially the same level above bottom dead center. As diagrammatically shown at line C in FIG. 6, the sensor produces a discrete output signal having a state S1 when the ram position sensor is in its normal position and a different state S2 when the sensor is moved out of its normal position. The sensor signal changes from S1 to S2 as indicated at SX1 in FIG. 6 when the plunger is actuated at ram position P1 and the sensor signal changes from S2 back to S1 as indicated at SX2, when the plunger is deactuated at ram position P2. As shown in FIGS. 1 and 5, the ram actuator 102 includes an adjustable member 102*a* to enable adjustment of the ram positions during each press cycle at which the ram position sensor is actuated and deactuated, and the actuator is preferably adjusted so as to actuate the ram position sensor at a level above bottom dead center before the pilot pins (if provided or the punch elements if no pilot pins are provided) engage the stock. Stated otherwise, the plunger actuator is adjusted so that the plunger is actuated before the pilot pins and/or punches engage the stock and deactuated after the pilot pins and/or punches disengage the stock.

Servomotors suitable for driving stock feed rolls and programable controllers therefor are well known and commercially available. As diagramtically illustrated in the block diagramed in FIG. 5, a programmable controller PC includes a timing clock, a central processing unit CPU and ROM and RAM memory. Feed command signals from an operator control interface are applied through a bus 120 to an input interface of the programable controller and ram position signals from the ram position sensor 101 are also supplied through a bus 112 the input interface of the programmable controller. A tachometer 121 and an encoder 122 are connected to the servomotor to provide feedback signals correlative to the speed and rotational position of the feed rolls. The tachometer 121 is connected through a bus 125 in a velocity loop to a servomotor drive amplifier 126 and the encoder 122 is connected through bus 127 to an encoder interface on the central processing unit to provide a position feedback loop. The digital output of the programmable controller is supplied through an analog interface or digital-to-analog converter D/A and bus 128 to the drive amplifier 126 for the servomotor. The operator interface is arranged to provide presetable feed command signals representative of the desired stock feed length and may, for example, comprise thumbwheel switches or another computer. As is conventional, programmable controller is operative in response to the feed command signals and to the feedback signals to control application of power to the servomotor to drive the feed rolls through an angle corresponding to the desired stock feed length and then stop the feed rolls.

As previously described, the ram position sensor 101 provides a discrete ram position signal that changes upon actuation from the state S1 to the state S2, and changes back from the state S2 to the state S1 upon deactuation. Once the position sensor actuator 102*a* is adjusted to actuate the ram position sensor at a preselected level above bottom dead center, the angular position of the press crank at which the ram actuates the sensor and the angular position of the press crank at which the ram deactuates the sensor, will remain fixed and will not change with changes in press speed. Thus, the change in the state of the ram position sensor signal upon actuation of the sensor, indicated at SX1 in line C of FIG. 6, and the change in sensor signal upon deactuation of the ram position sensor indicated at SX2, occur at fixed points during each revolution of the press crank. The change in the sensor signal upon deactuation is utilized in a manner described more fully hereinafter to actuate the servomotor control means to drive the servomotor through a stock feed cycle in timed relation with the operation of the press. The change in ram position sensor signals at SX1 and SX2 are also utilized in a manner described more fully hereinafter to produce an output signal representative of a third ram position P3 that is intermediate the ram positions P1 and P2 is actuated and deactuated, and which output signal is utilized to time movement of the feed rolls into feeding engagement with the stock. In addition, the time intervals between successive actuations of the ram position sensor are measured to provide a signal correlative with the press feed.

Figure 6:
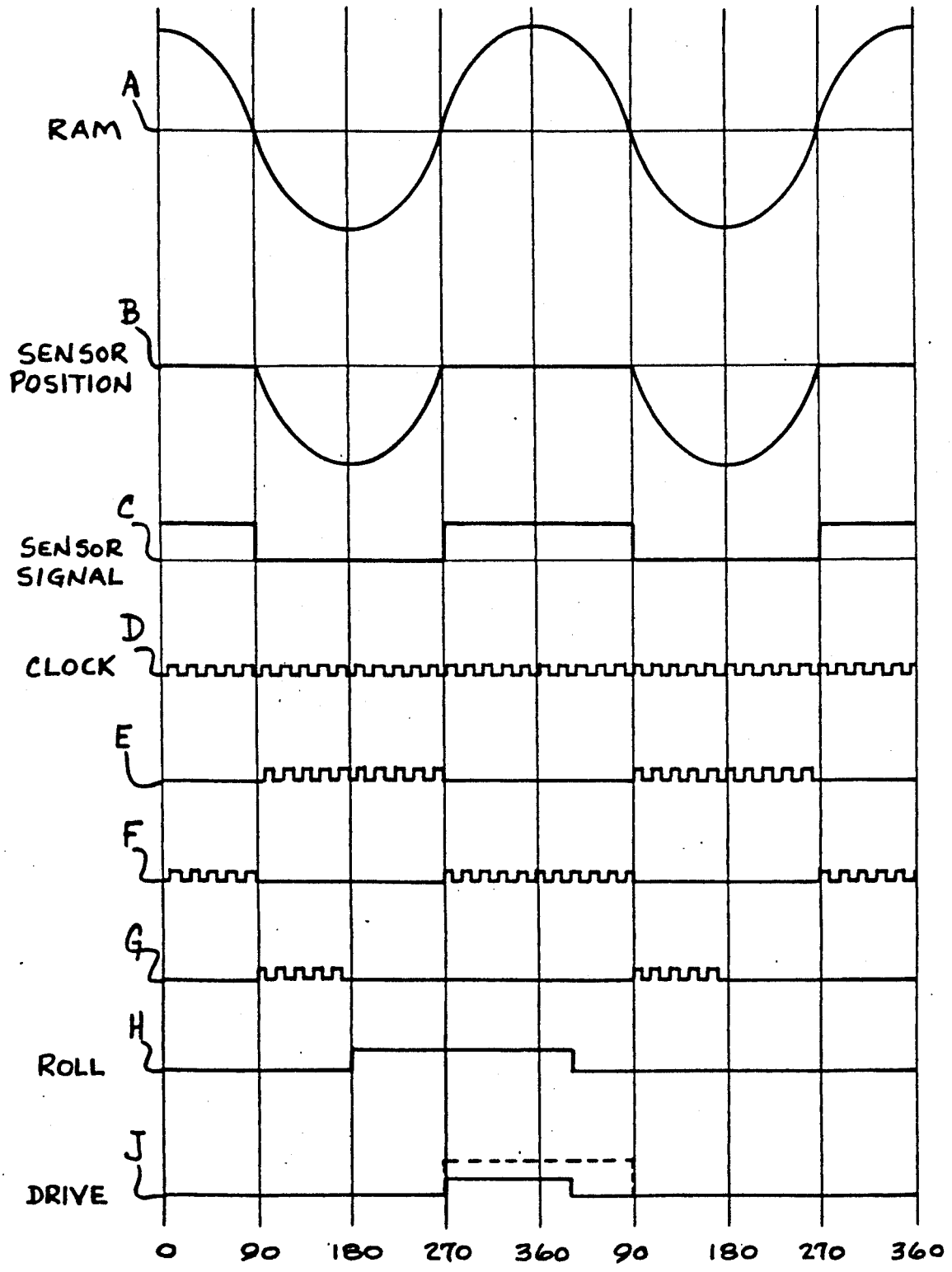
FIG. 6 is a timing diagram of a feed apparatus control system.

Timing is preferably measured by digital type timing means which count timing pulses P such as diagrammatically shown at line D of FIG. 6 during the selected time interval. While the timing functions described hereinafter can be performed by discrete counters and interfaced to the programmable controller, the timing functions are preferably performed by the CPU of the programable controller PC with timing pulses derived from the clock of the programmable controller. For this purpose, the controller is programmed so that it is operative, during each revolution of the press, to start count of the timing pulses when the ram position sensor signal changes to state S2 upon actuation of the sensor and to stop counting pulses when the sensor signal changes back to state S1, upon deactuation of the ram position sensor to produce a count C correlative with the time interval between actuation and deactuation as diagrammatically shown on line E in FIG. 6. The controller is programmed to also count timing pulses during the interval between deactuation and the subsequent actuation of the ram position sensor to provide a count C1 correlative with the time interval between deactuation and the subsequent actuation of the sensor, as indicated on the line F in FIG. 6. The counts C and C1 are summed in the processor to provide a total count correlative with the total time interval between successive actuations of the ram position sensor, which total count is correlative with the press speed. The total count is advantageously used to calculate press speed and to operate a press speed display diagrammatically indicated at 135 in FIG. 6.

Air control valve 86 has an actuator solenoid 90 operable to move the valve between supply and exhaust positions to shift the upper feed roll 35 between respective stock release and stock engaging positions, and the ram position sensor is also arranged to provide an output timing signal for actuating the solenoid 90 to shift the feed roll 35 into stock engaging position at a preselected ram position P3 intermediate the ram positions P1 and P2 at which the sensor is actuated and deactuated. More specifically, the pulse count C between actuation and deactuation of the ram position sensor is divided by a preselected constant N, to produce a pulse count C/N as indicated on line G in FIG. 6, where the constant N is greater than unity and preferably about two. The quotient of C/N in each press cycle is temporarily stored in a register in the processor and used in the subsequent press cycle to apply a valve actuating signal to the actuator 90 for valve 86 at a ram position P3 that is C/N pulses after the ram position sensor is actuated at ram position P1 in the next revolution of the press. The count C could be applied to a discrete divide-by-N counter. However, the CPU in the controller PC is preferably used to divide the pulse count C between actuation and deactuation of the sensor and apply a signal to the output interface for changing the voltage applied through a bus 131 to solenoid 90, from a level V1, to a level V2 at ram position P3, as indicated at line H in FIG. 6. When the voltage V2 is applied to actuator 90, the valve 86 is actuated to an exhaust position and causes the actuator piston 71 to move the upper feed roll into the stock engaging position. Although the pulse count C between actuation and deactuation of the ram position sensor at ram positions P1 and P2 changes as the press speed changes, the ram position P3 at which the output signal changes from V1 to V2 is automatically adjusted to occur at the preset ratio 1/N of the pulse count C, after ram position P1. Thus, ram position P3 remains substantially fixed with relation to ram positions P1 and P2.

As previously described, the ram position sensor signal is applied to the input interface of the programmable controller and the change in state of the ram position sensor signal indicated at SX2 in line C of FIG. 4 that occurs upon deactuation of the ram position sensor at ram position P2, is arranged to initiate a servomotor feed cycle as indicated at F1 in line J of FIG. 6. The servomotor is programmed to respond to the feed command signals and the feedback signals to drive the feed rolls during a stock feed time indicated at F1 in line J of FIG. 6, to advance the stock through the desired feed length and then stop the feed rolls as indicated at F2. The stock feed time required to feed the stock will vary with the feed length and the rate of acceleration and deceleration of the stock feed rolls but must occur during a feed window indicated at Fw in FIG. 6. Thus, the stock feed time must be completed before the punch assemblies engage the stock and, when the punch assemblies have pilot pins, the stock feed time must end at a point in the crank rotation such as to allow sufficient time to move the stock feed roll out of engagement with the stock before the pilot pins enter the pilot holes in the stock. Provision is made for actuating control valve 86 to a position to effect raising of the upper feed roll, when the servomotor has stopped driving the feed rolls. As is conventional, the servomotor controller has circuits for comparing the command position signal with the encoder feedback signal, and the servomotor controller is arranged to apply a signal to the output interface to actuate valve 86 to its open position when the following error, that is the difference between the commanded position and the roller position sensed by the encoder 32, decreases to zero. As schematically shown in line H of FIG. 6, the signal applied to the actuating solenoid 90 for valve 86 is changed from V2 to V1 as indicated at VX, to raise the upper feed roll when the feed rolls stop as indicated at F2 in line J.

The embodiments of the invention in which an exclusive property or privilege is claimed are defined as follows:

1. A roll type stock feed apparatus for a punch press of the type having a base and a ram mounted for vertical reciprocation relative to the base and crank means operable during each revolution to drive the ram means from top dead center through a down stroke to bottom dead center and through an upstroke back to top dead center, the stock feed apparatus including: feed frame means; a pair of feed rolls mounted on the feed frame means; electro-responsive servomotor means mounted on the feed frame means and drivingly connected to at least one of the feed rolls; ram position sensor means mounted on the feed frame means and operable to produce a discrete ram position signal having a first state when the sensor means is in a normal position and a second state when the sensor means is displaced from the normal position; and sensor actuator means mounted on the ram means for reciprocation therewith into and out of engagement with the ram position sensor means, the actuator means being constructed and arranged to actuate the sensor means from the normal position to a displaced position when the ram means moves in a downstroke to a preselected level above bottom dead center and to deactuate the ram position sensor means when the ram means thereafter moves in the upstroke to a preselected level above bottom dead center, programmable servomotor control means actuatable in response to a feed cycle initiate signal for driving the servomotor through a feed cycle, said servomotor control means including feed command means for providing a feed command signal representative of a desired stock feed length; feedback means for producing feedback signals correlative with the speed and rotational position of the feed rolls; and means responsive to said feed command signal and said feedback signals for controlling application of power to said servomotor means to drive the feed rolls through an angle corresponding to the desired stock feed length, and means responsive to the change in the ram position signal from said second state to said first state when the ram position sensor is deactuated for producing a cycle initiate signal to actuate said servomotor control means.

2. A roll type stock feed apparatus according to claim 1 wherein the ram position sensor means includes plunger means mounted on the feed frame means for vertical reciprocation relative thereto.

3. A roll type stock feed apparatus according to claim 1 including means for shifting one feed roll relative to the other feed roll between a stock gripping position and a stock release position, said means for shifting said one feed roll including a double acting piston having first and second sides and a piston rod extending from the second side and operatively connected to said one feed roll, said feed roll frame including cylinder means defining a first actuator chamber at the first side of the piston and a second actuator chamber at the second side of the piston, means including a pressure regulator for supplying air under a substantially constant first pressure to said first actuator chamber for moving the piston in a direction to move said one feed roll toward the other feed roll, and selectively operable means for controlling air pressure in the second actuator chamber, said selectively operable means including valve means operable in a first condition to supply pressurized air at a second pressure sufficient to move the piston against the first pressure in the first actuator chamber and operative in a second condition to rapidly exhaust air from the second actuator chamber.

4. A roll type stock feed apparatus according to claim 3 wherein said selectively operable means includes an electro-responsive three-way valve connected by a line to said second actuator chamber, and a quick exhaust valve in said line.

5. A roll type stock feed apparatus according to claim 3 including a pneumatic accumulator between said pressure regulator and said first actuator chamber.

6. A roll type stock feed apparatus according to claim 3 including means for producing timing pulses, means responsive to said ram position signal for counting timing pulses during the interval between actuation and deactuation of the ram position sensor in one press cycle and for dividing the count C of timing pulses by a constant N, where N is is greater than one, means for producing an output timing signal at C/N timing pulses following actuation of the ram position sensor in the next press cycle, and means responsive to said output timing signal for operating said valve means to said first condition.

7. A roll type stock feed apparatus according to claim 6 including means operative during each revolution of the press after said feed rolls are stopped and before said ram position sensor is actuated for operating said valve means to said second condition.

8. A roll type stock feed apparatus according to claim 1 including timing means responsive to said ram position signal for timing the interval between successive actuations of the ram position sensor, and for calculating the rotational speed of the press.

9. A roll type stock feed apparatus according to claim 1 including clock means for producing timing pulses, and means responsive to said ram position signal for counting timing pulses during the interval between actuation and deactuation of the ram position sensor means and during the succeeding interval between deactuation and actuation of the ram position sensor means and for calculating the rotational speed of the press.

10. A roll type stock feed apparatus according to claim 1 including clock means for producing timing pulses, means responsive to said ram position signal for counting timing pulses during the interval between actuation and deactuation of the ram position sensor in one revolution of the press and for dividing the count C of timing pulses by a constant N where N is greater than one, and means for producing an output timing signal at C/N pulses following actuation of the ram position sensor in the next revolution of the press.

11. A roll type stock feed apparatus according to claim 10 wherein N is substantially equal to 2 such that the output timing pulse occurs at approximately ram bottom dead center.

12. A roll type stock feed apparatus according to claim 10 including means for counting the timing pulses during the interval between deactuation and actuation of the ram position sensor, and means responsive to the total timing pulses during each revolution for calculating the rotational speed of the press.

13. A roll type stock feed apparatus for a punch press of the type having a base and a ram mounted for vertical reciprocation relative to the base and crank means operable during each revolution to drive the ram means from top dead center through a down stroke to bottom dead center and through an upstroke back to top dead center, the stock feed apparatus including feed frame means, a pair of feed rolls mounted on the feed frame means; electro-responsive servomotor means mounted on the feed frame means and drivingly connected to at least one of the feed rolls; programmable servomotor control means actuatable to drive the servomotor through a feed cycle, the servomotor control means including feed command means for providing a feed command signal representative of a desired stock feed length; feedback means for producing feedback signals correlative with the speed and rotational position of the feed rolls; and means responsive to said feed command signal and said feedback signals for controlling application of power to said servomotor means to drive the feed rolls through an ángle corresponding to the desired stock feed, means for moving said one feed roll between a stock gripping and a stock release position, said means for moving said one feed roll including a double acting piston having first and second sides and a piston rod extending from the second side and operatively connected to said one feed roll, said feed roll frame including cylinder means defining a first actuator chamber at the first side of the piston and a second actuator chamber at the second side of the piston, means including a pressure regulator for supplying air under a substantially constant first pressure to said first actuator chamber sufficient to move the piston in a first direction and press said one feed roll toward the other feed roll into stock gripping position, and selectively operable means for controlling air pressure in the second actuator chamber, said selectively operable means including valve means operative in a first condition to supply pressurized air at a second pressure sufficient to move said piston in a second direction against the first pressure in the first actuator chamber to a stock release position, said valve means being operative in a second condition to rapidly exhaust air from the second actuator chamber to allow said one feed roll to move into stock gripping positions under the pressure in said first actuator chamber, and means for actuating said servomotor control means in timed relation with the press.

14. A roll type stock feed apparatus according to claim 13 wherein said selectively operable means includes an electro-responsive three-way valve connected by a line to said second actuator chamber, and a quick exhaust valve in said line.

15. A roll type stock feed apparatus according to claim 13 including a pneumatic accumulator between said pressure regulator and said first actuator chamber.

16. A roll type stock feed apparatus for a punch press of the type having a base and a ram mounted for vertical reciprocation relative to the base and crank means operable during each revolution to drive the ram means from top dead center through a down stroke to bottom dead center and through an upstroke back to top dead center, the stock feed apparatus including feed frame means; a pair of feed rolls mounted on the feed frame means; electroresponsive servomotor means mounted on the feed frame means and drivingly connected to at least one of the feed rolls; ram position sensor means operable to produce a first ram position signal when the sensor means is actuated and to produce a second ram position signal when the sensor means is deactuated; sensor actuator means adapted for mounting on the ram means for reciprocation therewith into and out of engagement with the ram position sensor means, the actuator means being constructed and arranged to actuate the sensor means when the ram means moves in a downstroke to a preselected level above bottom dead center and to deactuate the ram position sensor means when the ram means thereafter moves in the upstroke to a preselected level above bottom dead center, programmable servomotor control means actuatable in response to a feed cycle initiate signal for driving the servomotor through a feed cycle, the programmable servomotor control means including, feed command means for providing a feed command signal representative of a desired stock feed length; feedback means for producing feedback signals correlative with the speed and rotational position of the feed rolls; and means responsive to said feed command signal and said feedback signals for controlling application of power to said servomotor means to drive the feed rolls through an angle corresponding to the desired stock feed length and then stop the feed rolls, means responsive to the second ram position signal for producing a cycle initiate signal to start stock feed, clock means for producing timing pulses, means responsive to said first and second ram position signals for counting timing pulses during the interval between actuation and deactuation of the ram position sensor in one revolution of the press and for dividing the count C clock pulses by a constant N, where N is greater than one, and means for producing an output timing signal at C/N clock pulses following actuation of the ram position sensor in the next revolution of the press.

17. A roll type stock feed apparatus according to claim 16 including feed roll shift means operable to move the feed rolls relative to each other into and out of feeding engagement with a stock strip, and means responsive to said output timing signal for operating said feed roll shift means to move the feed rolls into feeding engagement with the stock strip.

18. A roll type stock feed apparatus according to claim 17 including means responsive to said second and said first ram position signals for counting the timing pulses during the interval between deactuation and actuation of the ram position sensor, and means responsive to the total clock pulses during each revolution of the press for calculating the rotational speed of the press.

19. A roll type stock feed apparatus according to claim 17 including means for operating said feed roll shift means to move the feed rolls out of feeding engagement with the stock strip, after the feed rolls are stopped and before said ram position sensor is actuated.

* * * * *